US006589368B1

(12) United States Patent
Takada et al.

(10) Patent No.: US 6,589,368 B1
(45) Date of Patent: Jul. 8, 2003

(54) HIGH MELTING POINT METAL BASED ALLOY MATERIAL HAVING HIGH TOUGHNESS AND STRENGTH

(75) Inventors: Jun Takada, Okayama (JP); Masahiro Nagae, Okayama (JP); Yutaka Hiraoka, Okayama (JP); Yoshito Takemoto, Okayama (JP)

(73) Assignee: Japan Science and Technology Corporation, Kawaguchi (JP)

( * ) Notice: Subject to any disclaimer, the term of this patent is extended or adjusted under 35 U.S.C. 154(b) by 0 days.

(21) Appl. No.: 09/926,591

(22) PCT Filed: Jul. 7, 2000

(86) PCT No.: PCT/JP00/04572

§ 371 (c)(1),
(2), (4) Date: Nov. 21, 2001

(87) PCT Pub. No.: WO01/18276

PCT Pub. Date: Mar. 15, 2001

(30) Foreign Application Priority Data

Sep. 6, 1999 (JP) ..... 11-252344

(51) Int. Cl.[7] ..... C22C 27/04; C22C 27/06; C23C 8/24

(52) U.S. Cl. ..... 148/317; 148/423; 148/238; 148/237

(58) Field of Search ..... 148/317, 423, 148/237, 238

(56) References Cited

U.S. PATENT DOCUMENTS 5,372,655 A 12/1994 Preisser et al.

FOREIGN PATENT DOCUMENTS

JP 53-37298 B 10/1978
JP 4-45578 B2 7/1992
JP 6-17556 B2 3/1994
JP 6-17557 B2 3/1994
JP 8-85840 A 4/1996

OTHER PUBLICATIONS

Patent Abstracts of Japan, Publication No. 11–012715, dated on Jan. 19, 1999.
Patent Abstracts of Japan, Publication No. 59–150073, dated Aug. 28, 1984.
M. Nagae et al.; International Journal of Refractory Metals & Hard Materials 16, pp. 127–132, 1998.
H. Kurishita et al; Journal of Nuclear Material 233–237; pp. 557–564, 1996.
S. Yano et al; The Research Institute for Iron, Steel and Other Metals, Tohoku University, pp. 658–664, 1979.
Summary of Japan Society of Powder and Powder Metallurgy, Hei–9 Spring Meeting, p. 255, 1997 (See p. 4 of the specification.).

*Primary Examiner*—Roy King
*Assistant Examiner*—Harry D. Wilkins, III
(74) *Attorney, Agent, or Firm*—Armstrong, Westerman & Hattori, LLP

(57) ABSTRACT

The present invention provides a refractory-metal-based alloy material having a remarkably enhanced toughness and strength, by internally nitriding a nitride-forming metal element incorporated as a solid solution into an alloy worked piece, which has a parent phase consisting of one element selecting from Mo, W and Cr, at a temperature equal to or lower than a recrystallization upper limit temperature of the worked piece to dispersedly yield ultra-fine nitride particles to the worked piece and thereby raise a recrystallization lower limit temperature of the worked piece, and then subjecting the internally nitrided worked piece to a second nitriding treatment at a temperature equal to or more than the raised recrystallization lower limit temperature, wherein at least in the surface region of the worked piece has a structure in which ultra-fine nitride precipitated particles are grown and stabilized with keeping the worked structure of the worked piece.

5 Claims, 5 Drawing Sheets

100nm

100μm

HIGH MELTING POINT METAL BASED ALLOY MATERIAL HAVING HIGH TOUGHNESS AND STRENGTH

TECHNICAL FIELD

The present invention relates to a structural material having high-temperature resistance, and particularly to a high toughness, high strength, refractory-metal-based alloy material of a nitride-particle dispersion-strengthened type containing either one refractory metal of Mo, W and Cr as a parent phase thereof. The present invention also relates to a method for manufacturing such a material.

BACKGROUNG ART

In various fields including aeronautic and space materials, exothermic materials and electronics, refractory metals or high melting point metals, such as Mo, W and Cr, are expected as a key material of the 21th century in terms of their dominate properties under high temperature.

For example, Mo has the following features;

(1) high melting point, about 2600° C., (2) relatively high mechanical strength superior to other refractory metals, (3) small thermal expansion coefficient next to tungsten (W), (4) excellent electric conduction and heat conduction properties, and (5) excellent corrosion resistance property against fused alkali metal or hydrochloric metal, and thereby Mo is used for the following various purposes;

(1) additional alloy element to steel materials, (2) components for electrodes or vessels (X-ray vessel, electrode for discharge lamp, CT electrode), (3) components for semiconductors (substrate for rectifier, lead electrode, sintering boat, crucible, heat sink), and (4) components for heat resisting structures (heating element for furnace, reflector). Additionally, its potential applications in the future include;

(5) optical components (mirror for laser), and (6) materials for nuclear reactors (reactor wall material, protective barrier material).

However, Mo has some shortcomings, such as poor corrosion resistance against oxidizing acids such as hot concentrated sulphuric acid or nitric acid, limited high-temperature strength, and considerable embrittlement due to recrystallization under high temperature.

Generally, a doped Mo material having high recrystallization temperature and high strength after recrystallization has been used for Mo plate components used under high temperature, such as a furnace heater or a deposition boat. This material has a parent phase of Mo added with one or more of Al, Si and K. As a manufacturing process for a material of such Mo plate components, there has been known a process in which a doped Mo sintered body including 0.3 to 3 weight % of oxide, carbide, boride and nitride of various metals is subjected to an area reduction working at a total working ratio of 85% or more, and the worked sintered body is then subjected to a heat treatment in the range of a temperature higher than a recrystallization temperature by 100° C. to 2200° C. so as to grow recrystallized grains thinner and longer (Japanese Patent Publication No. Hei 06-17556 and Japanese Patent Publication No. Hei 06-17557).

Further, as an improved material in the shortcoming of Mo on the embrittlement due to recrystallization under high temperature, an alloy added with Ti, Zr and C, so-called TZM alloy, has been known from old times. The TZM alloy has been used for high-temperature members because of its lower ductile-brittle transition temperature (approximately −20° C.) than that of Mo, and its high recrystallization temperature (approximately 1400° C.). However, the TZM alloy has suffered a restricted use at 1400° C. or more in addition to a shortcoming of poor workability.

On the other hand, for using Mo as high-temperature materials, it is important to provide a higher recrystallization temperature so as to restrain the embrittlement in the material arising from grain growth. It has been reported that a Mo—TiC alloy or the like with dispersed carbide could have a restrained recrystallization under high temperature (H. Kurishita, et. al., J. Nucl. Mater. 223–237, 557, 1996). Japanese Patent Laid-Open Publication No. Hei 08-85840 also discloses to produce a Mo alloy capable of reducing the embrittlement due to recrystallization by using a mechanical alloying and HIP processes to disperse ultra-fine particles of VI group transition metal carbide, which has a particle size of 10 nm or less, in the range of 0.05 mol or more to 5 mol or less and to provide a crystal gain size of 1 $\mu$m or less.

Further, there have been known a process for improving thermal shock resistance and wear resistance by heating an alloy, which includes Mo added with 0.5 to 2.0 weight % of either one or both of Ti and Zr, up to 1100 to 1300° C. under forming gas, and then subjecting the heated alloy to nitriding (Japanese Patent Publication No. Sho 53-37298), a process for improving high-temperature strength and workability by internally nitriding a Mo-0.01 to 1.0 weight % Zr alloy at 1000 to 1350° C., preferably at 1100 to 1250° C. (Japanese Patent Publication No. Hei 04-45578), a process of internally nitriding a Mo-0.5 to 1.0 weight % Ti alloy at 1300° C. under $N_2$ gas (J. Japan Inst. Metals, 43, 658, 1979), etc. The inventors and others have been reported that mechanical strength could be significantly improved by preferred nitriding of a diluted Mo—Ti alloy at about 1100° C. to disperse and precipitate nano-scale ultra-fine TiN particles (Summary of Japan Society of Powder and Powder Metallurgy, Hei-9 Spring Meeting, 255, 1997).

While the refractory metals or high melting point metals are expected as ultra-high-temperature resisting structural materials, such as nuclear fusion reactor wall materials, aeronautic and space materials or the like, neither effective development for exploring their application nor their practical application have been done. A principal factor thereof is their low temperature brittleness originated from brittleness of grain boundaries.

A Mo material subjected to a heavy working such as rolling has a fine structure in which grains are deformed in the rolling direction, and exhibits an excellent ductility even in relatively low temperature range lower than ambient temperature. However, once this Mo material is used at a high temperature of 900° C. or more, the resulting recrystallization provides an equi-axed grain structure allowing a crack to extend linearly, and its ductile-brittle transition temperature goes up approximately to ambient temperature. This causes a hazardous nature such that even at ambient temperature, an intercrystalline crack is generated only by dropping the Mo recrystallized material down to a floor. Thus, it is required to restrain the recrystallization at possibly higher temperature. However, despite various efforts to this improvement, no sufficient solution has been achieved.

The material produced by dispersing TiC through the powdered particle mixing process and then subjecting to the HIP process has a high recrystallization temperature of about 2000° C. and a high high-temperature strength. However, resulting products are restricted in size or configuration, and it is disadvantageously difficult to shape and convert this material into a desired product due to the high hardness of the material produced by using the HIP process. Thus, it has been expected to develop a high strength and high toughness material produced by working or shaping a raw material into any configuration suitable for a desired product in advance and then dispersing particles therein. The material produced by internally nitriding a diluted alloy including a small amount of Ti and/or Zr may provide a certain degree of high-temperature strength. However, if this material is subjected, for example, to a post-annealing treatment at 1200° C. under vacuum pressure for one hour, the ultra-fine nitride particles will be consumed, resulting in lost capability to restrain recrystallization.

DISCLOSURE OF INVENTION

In order to solve the problem, it is an object of the present invention to provide a refractory-metal-based alloy material having a significantly enhanced toughness and strength yielded by controlling a configuration (platy-shape, spherical-shape) and size distribution of ultra-fine nitride dispersed particles and by pinning grain boundaries with the dispersed particles so as to restrain recrystallization.

More specifically, the present invention provides a high toughness, high strength, refractory-metal-based alloy material of a nitride particle dispersed type, comprising an alloy worked piece having a parent phase consisting of one element selected from Mo, W and Cr, and containing a fine nitride dispersed in the parent phase. The fine nitride is formed by internally nitriding a nitride-forming metal element incorporated as a solid solution into the alloy worked piece. Further, at least the surface region of the alloy material has a structure in which nitride particles precipitated in the alloy material have grown with keeping the worked structure of the worked piece.

When the alloy material is relatively thin, the alloy material may include the worked structure maintained additionally inside the alloy material. That is, in this case, the alloy material has no recrystallized structure interiorly. When the alloy material is relatively thick, the alloy material may have a two-layer structure including a recrystallized structure inside the alloy material.

The present invention also provides a manufacturing method of a high toughness, high strength, refractory-metal-based alloy material of a nitride particle dispersed type, comprising the steps of: preparing an alloy worked piece having a parent phase consisting of one element selected from Mo, W and Cr, wherein a nitride-forming metal element consisting of at least one element selected from Ti, Zr, Hf, V, Nb and Ta is incorporated into the alloy worked piece as a solid solution; heating the alloy worked piece in the range of a temperature lower than a recrystallization lower limit temperature the alloy worked piece by 200° C. to a recrystallization upper limit temperature of the alloy worked piece under nitriding atmosphere to disperse ultra-fine nitride particles of the nitride-forming metal element, as a first nitriding treatment; and heating the first resulting alloy worked piece obtained from the first nitriding treatment at a temperature equal to or higher than a recrystallization lower limit temperature of the first resulting alloy worked piece under nitriding atmosphere to grow and stabilize the dispersed ultra-fine nitride particles by the first nitriding treatment, as a second nitriding treatment.

In the above manufacturing method, third, fourth and further nitriding treatments may be additionally performed. The third or subsequent nitriding treatment may include the step of heating the precedent resulting alloy worked piece obtained from the second or subsequent nitriding treatment at a temperature equal to or higher than a recrystallization lower limit temperature of the precedent resulting alloy worked piece under nitriding atmosphere to further grow and stabilize the dispersed ultra-fine nitride particles by the second or subsequent nitriding treatment.

According to the manufacturing method of the present invention, in the first nitriding treatment, nitrogen diffuses in the worked piece with keeping the worked structure of the diluted alloy worked piece to preferably nitride the nitride-forming metal element incorporated into the parent phase as a solid solution so as to form the ultra-fine nitride particles and disperse them throughout the parent phase. The term "diluted alloy" herein means an alloy including a dissolved element as a solid solution alloy in low concentration or at a small amount of about 5 weight % or less. The term "preferred nitriding" herein means a phenomenon that not the metal in the parent phase but only the nitride-forming element is nitrided preferably.

As compared with conventional nitriding processes, the manufacturing method of the present invention is characterized by the multi-step nitriding. The nitriding treatments in the multi-step nitriding according to the present invention provide different effects, respectively. Specifically, these treatments act to control the size, distribution and configuration of the nitride particles so as to provided a high strength in the alloy material, to block the movement of the grain boundaries during treatments and restrain the recrystallization of the alloy material so as to significantly raise the recrystallization temperature, and to maintain the worked structure so as to provide a high toughness in the alloy material. Thus, these actions can provide a high strength and high toughness in the wide range of a low temperature (about −100° C.) to a high temperature (about 1800° C.) to the alloy material.

The first nitriding step is performed at a temperature lower than an internally nitriding temperature of 1100° C. or more, which has been heretofore known. The first nitriding step may be performed under any atmosphere selected from ammonia gas atmosphere, $N_2$ gas atmosphere, forming gas atmosphere (hydrogen gas:nitrogen gas1:9 to 5:5), and an atmosphere formed by subjecting one of these three gases to plasma arc discharge.

In the second or subsequent nitriding treatment, the particles precipitated in the surface region of the alloy worked piece are grown and stabilized with keeping the worked structure of the diluted alloy worked piece. The inside of the alloy worked piece is recrystallized at this nitriding temperature. The second nitriding step may be performed under any atmosphere selected from ammonia gas atmosphere, $N_2$ gas atmosphere, forming gas atmosphere (hydrogen gas:nitrogen gas=1:9 to 5:5), and an atmosphere formed by subjecting one of these three gases to plasma arc discharge. If the second nitriding treatment is performed, for example, under non-nitriding atmosphere such as Ar gas atmosphere, the nitride particles precipitated in the first nitriding treatment will be decomposed within the parent phase and completely consumed, resulting in no pinning source.

The nitride-forming metal element selected from Ti, Zr, Hf, V, Nb and Ta to be incorporated into the alloy worked piece as a solid solution may be added singly or added by combining either two or more of them. The content of this element may be 0.1 to 5.0 wt %, more preferably 1.0 to 2.0 wt %. When this content is less than 0.1 wt %, TiN particles will not be sufficiently precipitated so that the recrystallization under high temperature environments cannot be suppressed. The content more than 5.0 wt % makes the nitrided material brittle, which provides an alloy material out of any practical use.

The solid solution alloy containing the nitride-forming metal element may be an alloy such as TZM alloy (e.g. Mo-0.5Ti-0.08Zr-0.03C), the TZC alloy (e.g. Mo-1.2Ti-0.3Zr-0.15C), which contains a small amount of metal element or non-metal element other than the nitride-forming metal element, for example carbon. In the TZM alloy or TZC alloy, the nitride particles of (Ti, Zr) N will be precipitated through the preferred nitriding.

A process for preparing the solid solution alloy containing the above nitride-forming metal element is not particularly limited, and this solid solution alloy may be prepared by any powder metallurgical processes or dissolution/coagulation processes.

With reference to FIG. 1, one case, in which a Mo-0.5 wt% Ti alloy worked piece having a parent phase of Mo and incorporating a nitride-forming metal element of Ti as a solid solution is subjected to a three-step nitriding treatment, will now be described. This process may also be applied to another alloy worked pieces, such as W or Cr alloy based worked piece.

Depending on manufacturing conditions of an associated raw material, such as degree of processing, a recrystallization temperature of the Mo-0.5 wt % Ti alloy worked piece as a starting material has a constant range of a recrystallization lower limit value TR0 to a recrystallization upper limit value TR'0, for example, of 950 to 1020° C. (FIG. 1 ①). Lager degree of processing, lower temperature causing the recrystallization.

A first nitriding treatment is a preferred nitriding treatment for precipitating ultra-fine TiN. In case of nitriding under 1 atm $N_2$ atmosphere, the ultra-fine TiN has a size of about 1.5 nm width and about 0.5 nm thickness, and a platy configuration. Each of particles precipitated by nitriding under 10 atm $N_2$ atmosphere has a smaller size of 2–4 nm width and a higher density than those of particles precipitated by nitriding under 1 atm $N_2$ atmosphere. The preferred nitriding in the Mo—Ti alloy as the starting material is caused in a temperature range of a temperature equal to or higher than that lower than the recrystallization lower limit temperature TR0 by 200° C., or TR0 minus 200° C. (e.g. 800° C.), to a temperature slightly lower than the recrystallization upper limit temperature TR'0 (e.g. 1020° C.). Thus, the heating temperature in the first nitriding treatment is set, for example, in 900° C. (FIG. 1 ②).

By subjecting to the first nitriding treatment, the recrystallization lower limit temperature can be raised higher (e.g. to 1000° C.). In the Mo—Ti alloy subjected to the first nitriding treatment, the amount and size of the TiN precipitated particles are changed in the depth from the surface of the worked piece. Thus, the range of the recrystallization lower limit value TR1 to the recrystallization upper limit value TR'1 becomes wider (FIG. 1 ③).

A second nitriding treatment is performed for growing and stabilizing the TiN particles. The heating temperature in the second nitriding treatment should be set in a temperature slightly lower than the recrystallization upper limit value TR'1 of the worked piece subjected to the first nitriding treatment. Thus, the heating temperature in the second nitriding treatment is set, for example, in 1300° C. (FIG. 1 ④).

By subjecting to the second nitriding treatment, the recrystallization lower limit temperature of the Mo—Ti alloy can be raised up to a higher value TR2 (e.g. to 1100° C.) (FIG. 1 ⑤). In addition, it is proved that each size of the particles becomes lager and the precipitated particles grows as the heating temperature in the second nitriding treatment is increased gradually from 1400° C. through 1500° C. to 1600° C.

A third nitriding treatment is performed for further growing and stabilizing the TiN particles. The heating temperature in the third nitriding treatment should be set in a temperature equal to or higher than the recrystallization lower limit value TR2 of the worked piece subjected to the second nitriding treatment and slightly lower than the recrystallization upper limit value TR'2 (i.e. 1600° C.) of the worked piece subjected to the second nitriding treatment. Thus, the heating temperature in the third nitriding treatment is set, for example, in 1500° C. (FIG. 1 ⑥). By subjecting to the third nitriding treatment, the recrystallization lower limit temperature of the Mo—Ti alloy can be raised up to a higher value TR3 (e.g. to 1550° C.), and the recrystallization upper limit temperature can be raised up to a higher value TR'3 (e.g. to 1800° C.) (FIG. 1 ⑦).

As described above, while the recrystallization temperature of pure Mo is originally about 900° C., and the recrystallization temperature of the Mo-0.5 wt % Ti alloy is originally around 1000° C., the Mo alloy according to the present invention can have a raised recrystallization temperature up to about 1800° C. by virtue of the multi-step nitriding treatment. In other words, an applicable upper limit in high temperature environment can be expanded from the conventional value of about 900° C. to about 1600° C.

It has been proved that when the TiN particles were grown through the multi-step nitriding treatment as described above, the recrystallization in the region of the worked piece having the dispersed TiN through the first nitriding treatment could be restrained with keeping the worked structure. In this manner, by dispersedly precipitating the ultra-fine TiN particles with controlled size and configuration within the Mo parent phase, a higher strength can be obtained. Further, the stabilized ultra-fine TiN particles act as pinning points for restraining the movement of the grain boundaries of the Mo, so that the recrystallization in the surface region of the worked piece can be restrained and the worked structure can be maintained, which provides a higher toughness.

FIG. 2 is a schematic diagram showing a structural change from a surface to an inside of a refractory-metal-based alloy material of the present invention. The figure shows a two-layer structure comprising a surface region of a worked piece including nitride precipitated particles which have grown with keeping the worked structure of the worked piece and an inside region having a recrystallized structure. The fine Ti nitride particles are dispersed to the depth of about 100 $\mu$m from the surface of the worked piece, and thereby the hardness in the surface region is greater than the inside region. In the Mo-0.5 wt % Ti alloy, the hardness Hv is in the range of 300 to 500.

FIG. 3 shows a relationship between a crosshead displacement (mm) and a stress (MPa) at 30° C., each for (a) a recrystallized material obtained by heating Mo-0.5 wt % Ti alloy at high temperature, (b) a material of the present invention obtained by subjecting Mo-0.5 wt % Ti alloy to the first and second nitriding treatments, (c) a material obtained by subjecting Mo-0.5 wt % Ti alloy to a heat/recrystallizing treatment under vacuum pressure at 1500° C. to form large grains in advance and then nitriding it under $N_2$ atmosphere at 1500° C. for 25 hours.

As seen in this figure, obtaining a Mo material by dispersedly precipitating nano-size TiN particles only in the surface region of the material through the first nitriding treatment and then subjecting the Mo material at least to the second nitriding treatment can provide a further raised recrystallization temperature and a higher toughness and strength. Further, the manufacturing method of the present invention employs a simple nitriding heat treatment and may use $N_2$ gas free from danger. In addition, since these treatments are performed after a shaping process for a desired product, the manufacturing method of the present invention can be applied to various products having different sizes and configurations requiring a high degree of accuracy.

BEST MODE FOR CARRING OUT THE INVENTION

EXAMPLE 1

A green compact was prepared by using a high purity Mo powder and a TiC powder as raw materials. This green compact was sintered under hydrogen atmosphere at 1800° C. to form a Mo-0.5 wt % Ti alloy sintered body. Then, this sintered body was subjected to a hot/warm rolling and further cold rolling to shape in a plate having a thickness of 1 mm, and a square-bar-shaped worked piece was cut out from the plate. The surface of the worked piece was polished by an emery paper, and then subjected to a electro polishing. For the first nitriding treatment, the priority nitriding was performed under 1 atm $N_2$ gas flow at 1000° C., which was slightly lower than an upper limit causing the recrystallization of the Mo-0.5 wt % Ti alloy, for 6 hours to produce the worked piece in which ultra-fine TiN particles were dispersed in the surface region of the worked piece.

For the second nitriding treatment, this worked piece was subjected to a heat treatment under $N_2$ gas flow at 1500° C. for 24 hours. A characterization on the obtained worked piece was performed by a structural observation (using TEM, optical microscope, etc.), a hardness test or the like.

Figure 1:
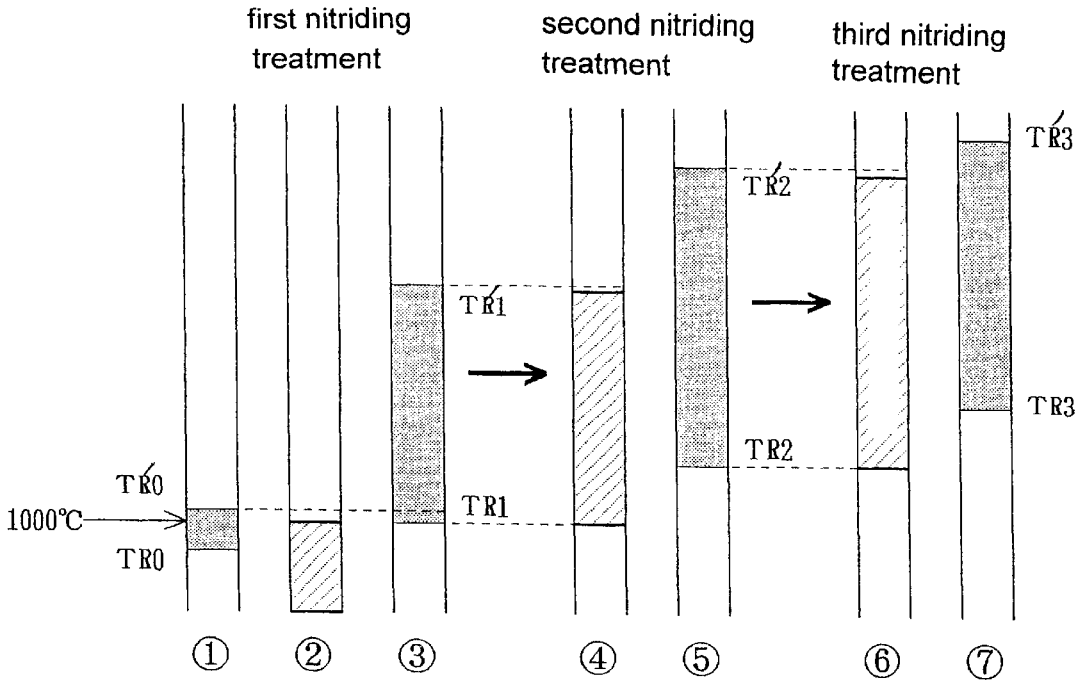
FIG. 1 is a schematic diagram showing a relationship between recrystallization temperatures and nitriding treatment steps.
Figure 2:
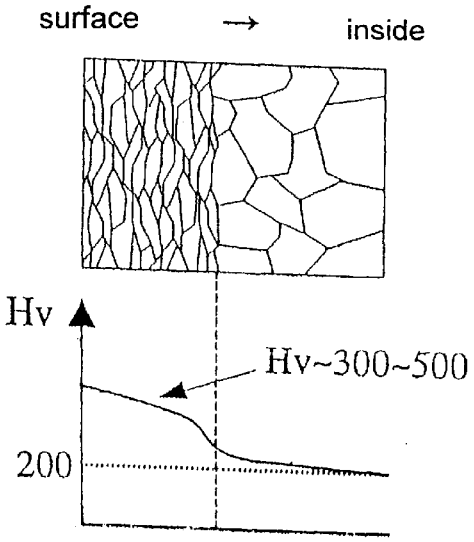
FIG. 2 is a schematic diagram showing a structural change from the surface to the inside of the refractory-metal-based alloy material of the present invention.
Figure 3:
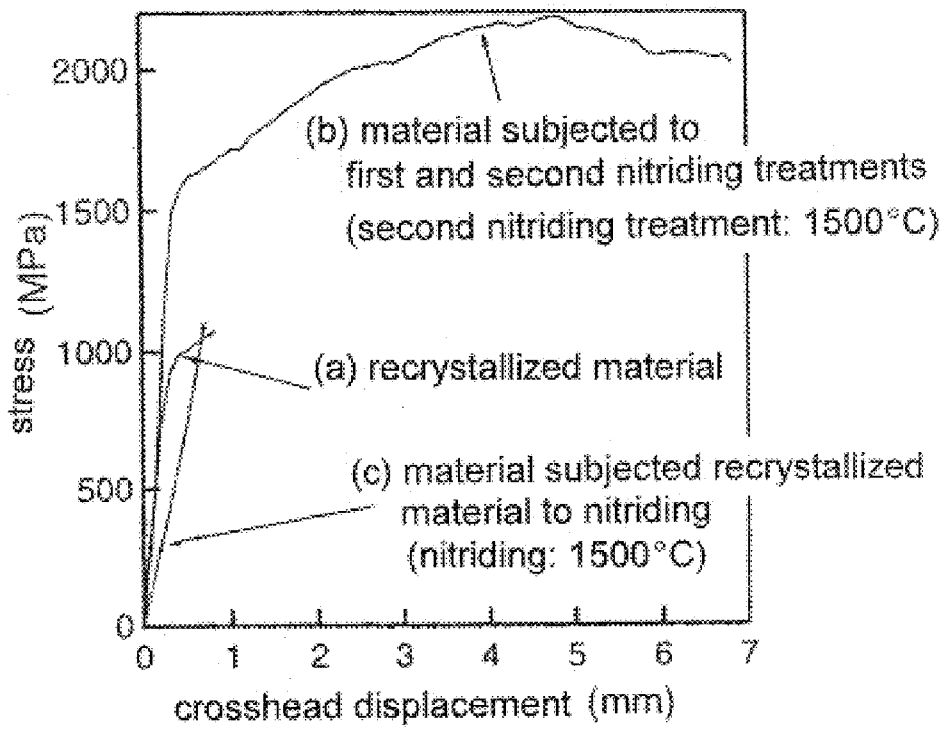
FIG. 3 is a graph showing a relationship between a crosshead displacement (mm) and a stress (MPa) each for the Mo-0.5 wt % Ti alloy worked piece of the present invention and a comparative worked piece.
Figure 4:
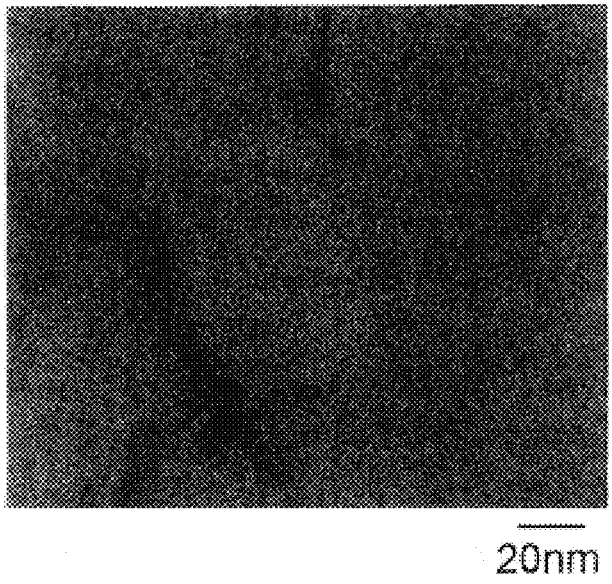
FIG. 4 is a transmission electron microphotograph for drawings showing the structure of the worked piece subjected to the first nitriding treatment.

FIG. 4 is a transmission electron microphotograph showing the structure of the worked piece with the ultra-fine TiN particles dispersed by the first nitriding treatment. Each of the TiN particles has a size of about 1.5 nm. The ultra-fine TiN particles are dispersedly precipitated within the Mo parent phase by the first nitriding treatment, and then the growth of the ultra-fine TiN particles (control of configuration and particle size), the expansion of the existing region of the fine TiN and other are caused in the second nitriding treatment.

Figure 5:
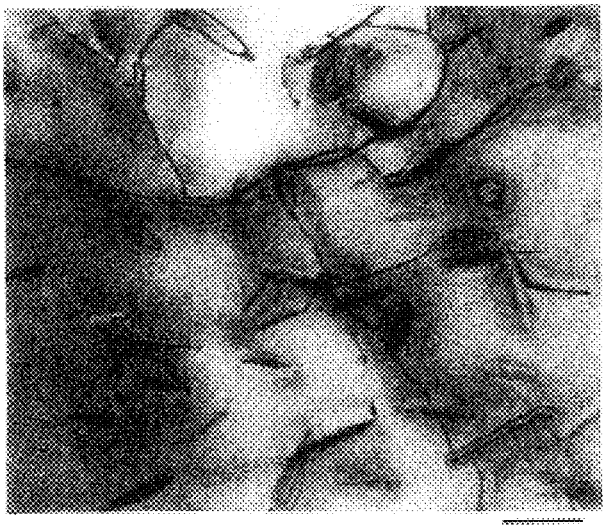
FIG. 5 is a transmission electron microphotograph for drawings showing the structure of the worked piece subjected to the second nitriding treatment.

FIG. 5 is a transmission electron microphotograph showing the structure of the worked piece subjected to the second nitriding treatment. In the region (a range of the surface to a depth of about 120 $\mu$m) where the ultra-fine TiN particles (each size of about 1.5 nm) have been dispersed by the first nitriding treatment, each of the TiN particles is grown and stabilized as a large (a diameter of about 10 to 20 nm, a length of about 40 to 150 nm) rod-shaped TiN particle with keeping the worked structure of the parent phase.

Figure 6:
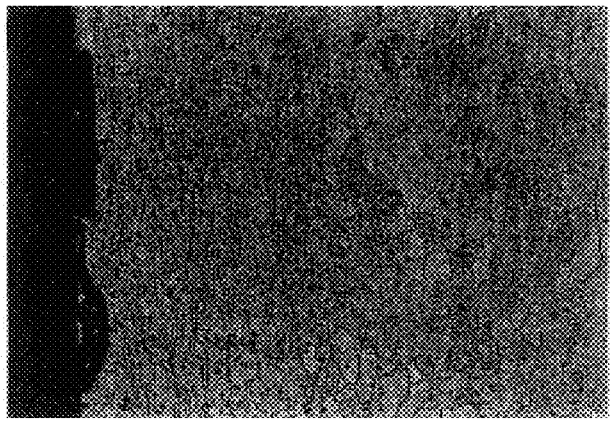
FIG. 6 is an optical electron microphotograph for drawings showing a structural change in case of post-annealing the worked piece subjected to the second nitriding treatment.

FIG. 6 is an optical microphotograph showing a structural change from the surface (left side) to the inside (right side) in case of post-annealing the worked piece, which has been subjected to the second nitriding treatment, under vacuum pressure at 1500° C. for 1 hour. In the region adjacent to the surface (a range of the surface to a depth of about 100 $\mu$m), a structure including crystal grains each having a small grain size is observed. Since no recrystallization has been caused, the worked structure of fine grains is maintained. This may be considered as a result of the restrained grain growth by the dispersion of the fine TiN particles.

Figure 7:
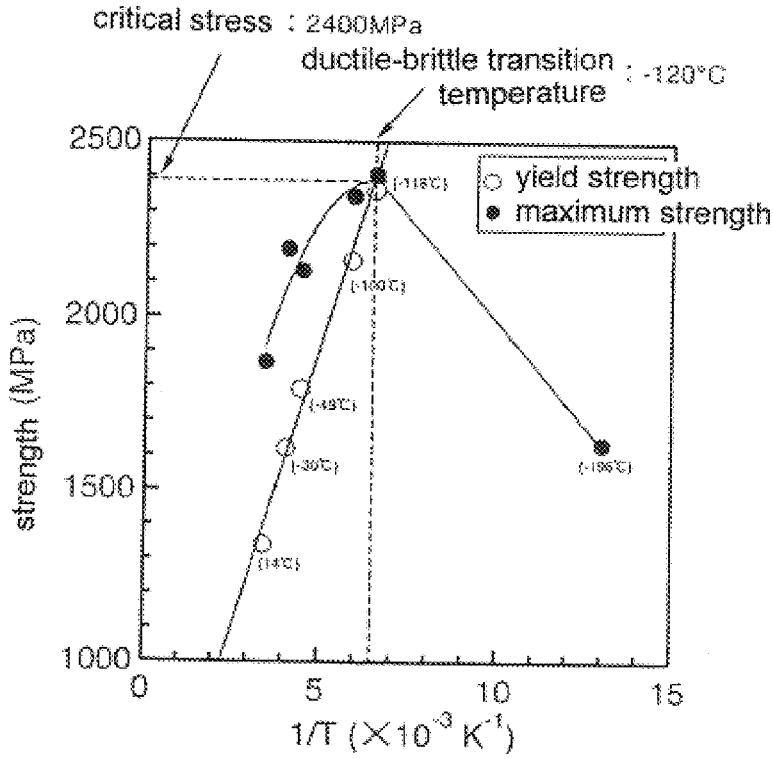
FIG. 7 is a graph showing a relationship between temperature and stress in a bending test of a worked piece obtained by subjecting a Mo-0.5 wt % Ti alloy to the first and second nitriding treatments.

FIG. 7 shows a relationship between temperature and stress in a bending test of the worked piece obtained by subjecting the Mo-0.5 wt % Ti alloy to the first nitriding treatment at 950° C. for 16 hours and the second nitriding treatment at 1500° C. for 24 hours. The ductile-brittle transition temperature is −120° C., and the critical strength (stress) runs up to 2400 Mpa.

EXAMPLE 2

Figure 8:
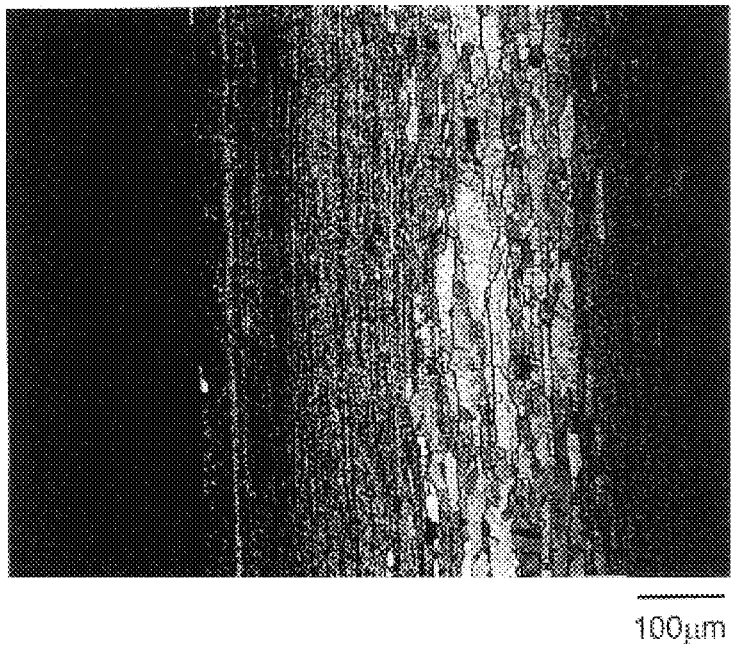
FIG. 8 is an optical microphotograph for drawings showing a worked structure of a TZM alloy worked piece as Example 2.

A TZM alloy worked piece (commercially available from Plansee Co., composition: Mo-0.5Ti-0.08Zr-0.03C) was subjected to the first nitriding treatment at 1200° C. for 24 hours, and then subjected to the second nitriding treatment at 1600° C. for 24 hours. FIG. 8 is an optical microphotograph showing the section of the worked piece. The temperature in the first nitriding treatment can be raised up because of high recrystallization temperature of the TZM alloy. It can be seen that the worked structure is maintained from the surface to a depth of about 300 $\mu$m.

COMPARATIVE EXAMPLE 1

Figure 9:
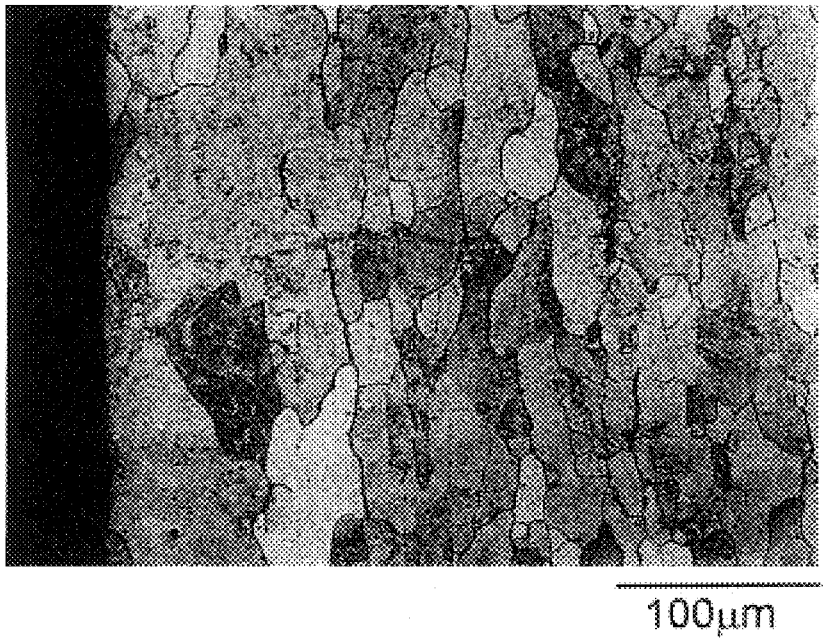
FIG. 9 is an optical microphotograph for drawings showing a structural change in case of post-annealing the Mo-0.5 wt % Ti alloy worked piece.

A Mo-0.5 wt % Ti alloy worked piece was subjected to the same treatment as that of Example 1, except that the second nitriding treatment was not performed. FIG. 9 is an optical microphotograph showing a structural change from the surface to the inside in case of post-annealing this worked piece under vacuum pressure at 1200° C. for 1 hour. It can be seen that the recrystallization is caused and thereby grains are enlarged.

INDUSTRIAL APPLICABILITY

The present invention provides an improved material having an exponentially enhanced toughness and strength under high temperature, compared to conventional materials, by providing a highly controlled structure, which has the worked structure in the surface region of the material and a recrystallized structure in the inside of the material, using dispersion and precipitation of ultra-fine particles. This novel material may be produced by a simple preferred nitriding treatment, and the working/treatment for this material may be readily performed in energy-saving manner because shaping processes for desired products may be performed before nitriding. Thus, this material has useful advantages of facilitating its practical application.

What is claimed is:

1. A high toughness, high strength, refractory-metal-based alloy material wherein nitride particles are dispersed, comprising an alloy worked piece having a parent phase consisting of one element selected from Mo, W and Cr, and containing a fine nitride dispersed in said parent phase, said fine nitride being formed by internally nitriding a nitride-forming metal element incorporated as a solid solution into said alloy worked piece, wherein at least the surface region of said alloy material has a structure in which nitride particles precipitated in said alloy material have grown while maintaining the worked structure of said worked piece.

2. A high toughness, high strength, refractory-metal-based alloy material wherein nitride particles are dispersed as defined in claim 1, which includes said worked structure maintained at the inside of said alloy material.

3. A high toughness, high strength, refractory-metal-based alloy material wherein nitride particles are dispersed as defined in claim 1, wherein the alloy material has a two-layer structure including a recrystallized structure inside said alloy material.

4. A manufacturing method wherein high toughness, high strength, refractory-metal-based alloy material wherein nitride particles are dispersed, comprising the steps of:

preparing an alloy worked piece having a parent phase consisting of one element selected from Mo, W or Cr, wherein a nitride-forming metal element consisting of at least one element selected from Ti, Zr, Hf, V, Nb or Ta is incorporated into said alloy worked piece as a solid solution;

heating said alloy worked piece in the range of a temperature lower than a recrystallization lower limit temperature of said alloy worked piece by 200° C. to a recrystallization upper limit temperature of said alloy worked piece under nitriding atmosphere to dispersedly form ultra-fine nitride particles of said nitride-forming metal element, as a first nitriding treatment; and heating the first resulting alloy worked piece obtained from said first nitriding treatment at a temperature equal to or higher than a recrystallization lower limit temperature of said first resulting alloy worked piece under nitriding atmosphere to grow and stabilize said dispersedly formed ultra-fine nitride particles by said first nitriding treatment, as a second nitriding treatment.

5. A manufacturing method of a high toughness, high strength, refractory-metal-based alloy material wherein nitride particles are dispersed, as defined in claim 4, which further includes the step of heating the precedent resulting alloy worked piece obtained from said second or subsequent nitriding treatment at a temperature equal to or higher than a recrystallization lower limit temperature of the precedent resulting alloy worked piece under nitriding atmosphere to further grow and stabilize the dispersedly formed ultra-fine nitride particles by said second or subsequent nitriding treatment.

* * * * *